US006053263A

United States Patent [19]

Meiners

[11] Patent Number: 6,053,263

[45] Date of Patent: Apr. 25, 2000

[54] CUTTING ELEMENT TIP CONFIGURATION FOR AN EARTH-BORING BIT

[75] Inventor: Matthew John Meiners, Spring, Tex.

[73] Assignee: Baker Hughes Incorporated, Houston, Tex.

[21] Appl. No.: 09/100,428

[22] Filed: Jun. 19, 1998

Related U.S. Application Data

[60] Provisional application No. 60/050,398, Jun. 20, 1997.

[51] Int. Cl.[7] ..... E21B 10/16

[52] U.S. Cl. ..... 175/331; 175/374; 175/426; 175/430

[58] Field of Search ..... 175/331, 426, 175/430, 374

[56] References Cited

U.S. PATENT DOCUMENTS

| | | | |
|---|---|---|---|
| 4,722,405 | 2/1988 | Langford, Jr. . | |
| 4,776,413 | 10/1988 | Forsberg . | |
| 5,172,777 | 12/1992 | Siracki et al. . | |
| 5,172,779 | 12/1992 | Siracki et al. . | |
| 5,322,138 | 6/1994 | Siracki . | |
| 5,348,108 | 9/1994 | Scott et al. . | |
| 5,415,244 | 5/1995 | Portwood | 175/374 |
| 5,421,424 | 6/1995 | Portwood et al. . | |
| 5,868,213 | 2/1999 | Cisneros et al. | 175/331 |

FOREIGN PATENT DOCUMENTS

WO 97/48873 12/1997 WIPO .

*Primary Examiner*—Eileen Dunn Lillis
*Assistant Examiner*—Sunil Singh
*Attorney, Agent, or Firm*—Felsman Bradley Vaden Gunter & Dillon, LLP; James E. Bradley

[57] ABSTRACT

An earth-boring bit has a bit body which connects to a drill string. Three cutters are rotatably secured to a bearing shaft of the bit and a large number of chisel-like cutting elements are secured to each cutter. Each cutting element has a cylindrical base and a cutting end. An elongate crest is located at the tip of the cutting end. A conical chamfer connects the crest and the cutting end. The junction created by the chamfer is non-tangential and reduces the amount of unsupported material at the crest. The conical contour of the chamfer is defined by by a straight line moving in an oval path about the longitudinal axis. The contour of the cutting end avoids abrupt changes and associated stress concentrations. This is achieved by avoiding surfaces of rotation in non-axisymmetric configurations. Alternatively, the contour of cutting end of element may be conventional and include flat surfaces, surfaces of rotation, and associated fillets and radii to soften the contour of the intersections between such surfaces. The chamfer reduces the sweep angle of the crest and the associated amount of material of the cutting element that is unsupported at a relatively low to moderate depth of penetration. Similarly, the amount of material of the cutting element left in tension and subject to chipping is reduced. The chamfer does not require modification of the radius of curvature of the crest, but alters the angle swept by the crest and the amount of material left unsupported.

9 Claims, 3 Drawing Sheets

CUTTING ELEMENT TIP CONFIGURATION FOR AN EARTH-BORING BIT

This application claims the benefit of earlier filed provisional U.S. appliction Ser. No. 60/050,398, filed Jun. 20, 1997.

FIELD OF THE INVENTION

This present invention relates generally to earth-boring bits of the rolling cutter variety. More particularly, the present invention relates the configuration of cutting elements employed on the cutters of such earth-boring bits.

DESCRIPTION OF THE PRIOR ART

The success of rotary drilling enabled the discovery of deep oil and gas reserves. The rotary rock bit was an important invention that made that success possible. Only soft formations could be commercially penetrated but with the earlier drag bit. The original rolling-cone rock bit, invented by Howard R. Hughes, U.S. Pat. No. 939,759, drilled the hard caprock at the Spindletop field, near Beaumont Tex., with relative ease.

That venerable invention, within the first decade of this century, could drill a scant fraction of the depth and speed of modern rotary rock bits. If the original Hughes bit drilled for hours, the modern bit drills for days. Bits today often drill for miles. Many individual improvements have contributed to the impressive overall improvement in the performance of rock bits.

Earth-boring bits typically are secured to a drill string, which is rotated from the surface. Drilling fluid or mud is pumped down the hollow drill string and out of the bit. The drilling mud cools and lubricates the bit as it rotates and carries cuttings generated by the bit to the surface.

Rolling-cone earth-boring bits generally employ cutting elements on the cutters to induce high contact stresses in the formation being drilled as the cutters roll over the bottom of the borehole during drilling operation. These stresses cause the rock to fail, resulting in disintegration and penetration of the formation material being drilled. The configuration of each individual cutting element, as well as the manner in which the elements are arranged on each cutter, can have significant impact on the rate of penetration and durability of a bit. Sharp configurations that may penetrate formation material easily with little application of force generally are subject to fracture due to the presence of stress concentrations arising as a result of the sharp corners and edges that accompany them. Conversely, blunt or dull element configurations have good durability, but sacrifice their ability to penetrate formation material rapidly and efficiently.

A need exists for improvements in cutting element configurations wherein both the formation penetration efficiency and the durability of the element in maximized.

SUMMARY OF THE INVENTION

An earth-boring bit has a bit body which connects to a drill string. Three cutters are rotatably secured to a bearing shaft of the bit and a large number of chisel-like cutting elements are secured to each cutter. Each cutting element has a cylindrical base and a cutting end. An elongate crest is located at the tip of the cutting end. A conical chamfer connects the crest and the cutting end. The junction created by the chamfer is non-tangential and reduces the amount of unsupported material at the crest. The conical contour of the chamfer is defined by a straight line moving in an oval path about the longitudinal axis. The contour of the cutting end avoids abrupt changes and associated stress concentrations. This is achieved by avoiding surfaces of rotation in non-axisymmetric configurations. Alternatively, the contour of cutting end of element may be conventional and include flat surfaces, surfaces of rotation, and associated fillets and radii to round or soften the contour of the intersections between such surfaces.

In operation, the chamfer reduces the included or sweep angle of the crest and the associated amount of material of the cutting element that is unsupported at a relatively low depth of penetration. Similarly, the amount of material of the cutting element that is left in a state of tensile stress and subject to chipping or spalling failure is reduced. The addition of the chamfer does not require modification of the radius of curvature of the crest, but alters the angle swept by the radius of the crest and the amount of material left unsupported at low-to-moderate depths of cut.

DETAILED DESCRIPTION OF THE INVENTION

Figure 1:
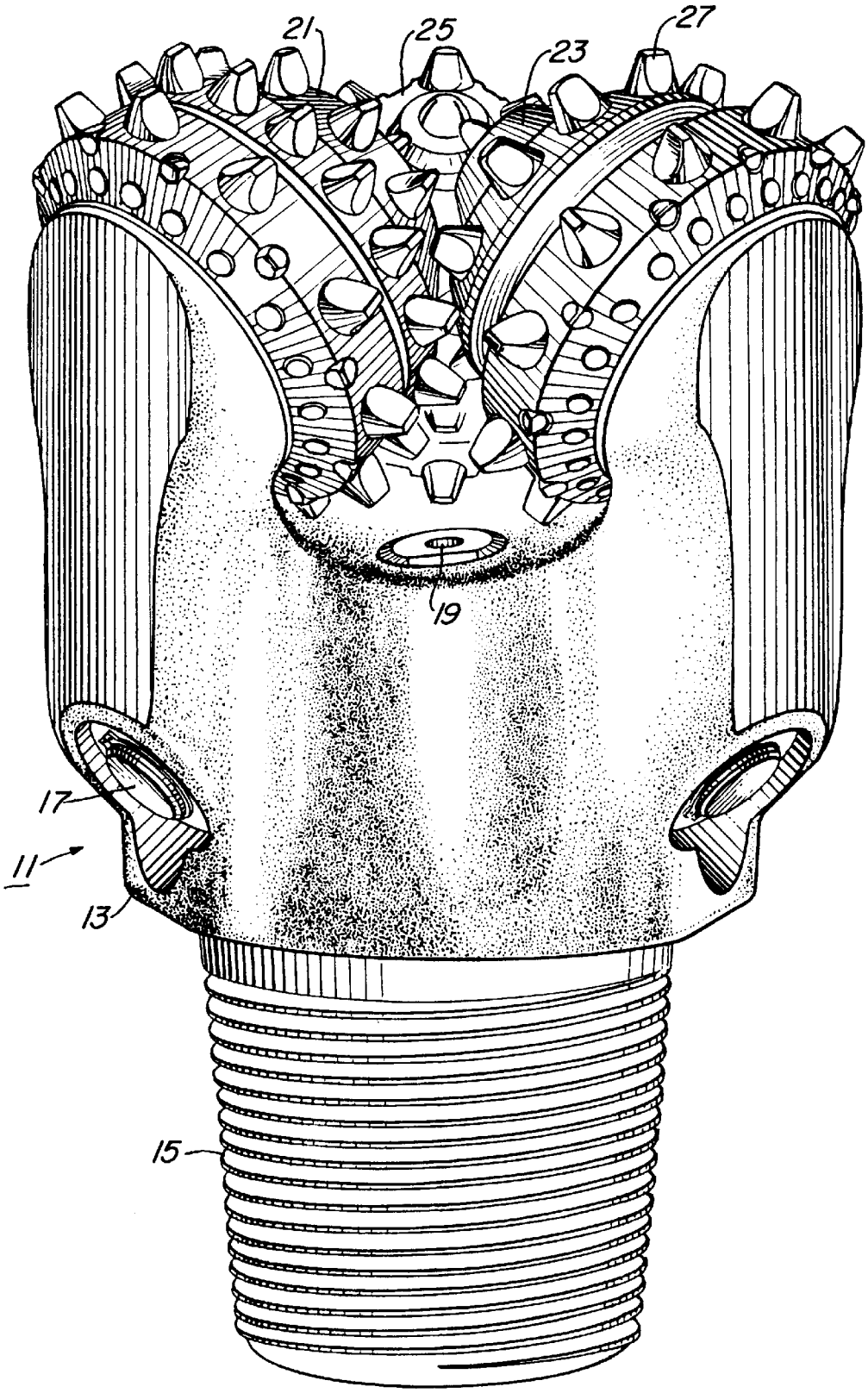
FIG. 1 is a perspective view of an earth-boring bit.

Referring now to the FIGS., and particularly to FIG. 1, an earth-boring bit 11 according to the present invention is illustrated. Bit 11 includes a bit body 13, which is threaded at its upper extent 15 for connection into a drill string. Each leg or section of bit 11 is provided with a lubricant compensator 17, which provides a lubricant to the bearings on which the cutters rotate. At least one nozzle 19 is provided in bit body 13 to spray drilling fluid from within the drill string to cool and lubricate bit 11 during drilling operation. Three cutters, 21, 23, 25 are rotatably secured to a bearing shaft associated with each leg of bit body 13.

A plurality of cutting elements 27 are arranged in generally circumferential rows on each cutter. According to the preferred embodiment of the present invention, cutting elements are formed of a hard metal, preferably cemented tungsten carbide, and are secured in appropriately dimensioned or corresponding holes or apertures in each cutter.

Figure 2:
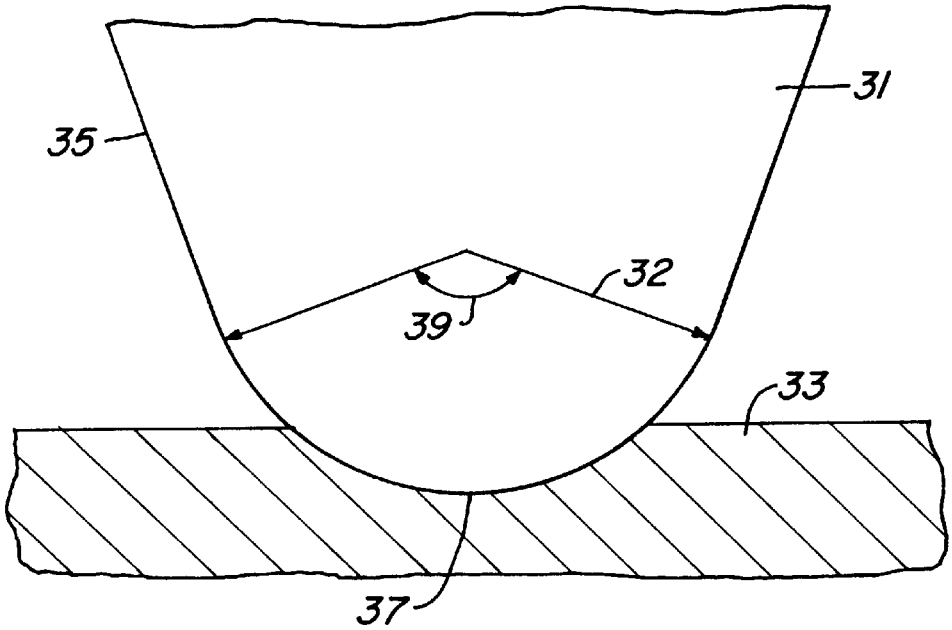
Fig. 2 (PRIOR ART)
FIG. 2 is an enlarged side sectional view of a prior-art cutting element engaging formation material.

With reference FIG. 2, a prior-art cutting element 31 of the tungsten carbide variety is illustrated engaging formation material 33. According to prior-art convention, cutting element 31 has a cutting end 35 that is provided with a contour of axisymmetric or asymmetric configuration (in this case, chisel-shaped) that may include conical shapes, chisel shapes, scoop shapes, or the like. Cutting end 35 is further provided with a crest 37 having the shape provided by a circular radius 32 that is tangent to or otherwise intersects the remainder of the cutting end 35 of element 31 in a relatively smooth manner to avoid stress concentrations. Radius 32 is not drawn from a single point on a single axis because crest 37 is elongated. As can be seen in FIG. 2, when crest 37 engages formation 33 at a relatively low-to-moderate depth of penetration or cut, radial portions of crest 37, defined by an angle 39, are left unsupported and in a state of tensile stress.

As is known, cemented carbides such as tungsten carbide have relatively poor strength when subjected to tensile, as opposed to compressive, stress. Therefore, cutting element 31 is subject to premature chipping and or spalling failures at crest 37 in the regions that are unsupported in relatively low-to-moderate depth of cut or penetration. Such failures can lead to a loss of sharpness in the crest or loss of durability of the element or insert, which can lead to reduced bit efficiency.

Figure 4:
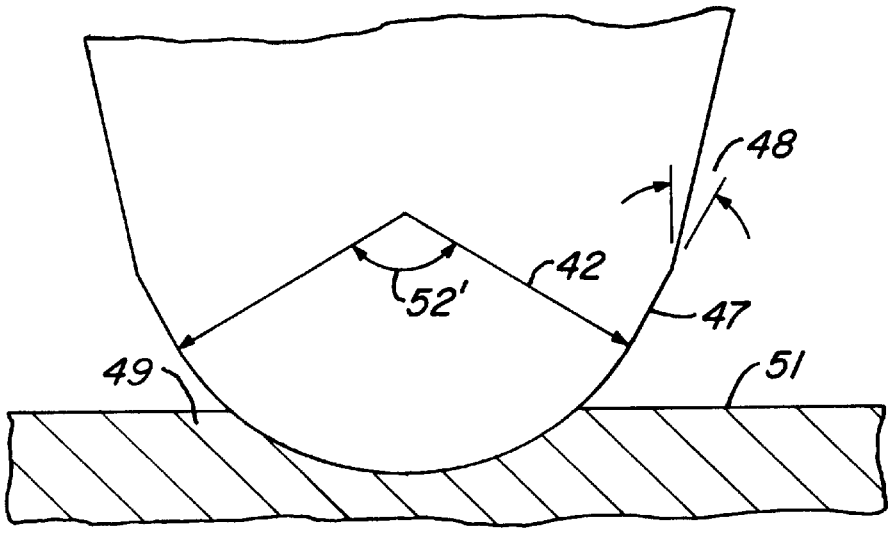
FIG. 4 is an enlarged side sectional view of the cutting element of FIG. 3 engaging formation material.
Figure 5:
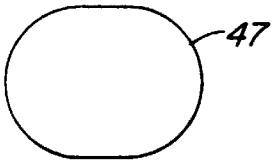
FIG. 5 is a top sectional view of the cutting element of FIG. 3 taken along the line 5—5 of FIG. 3.
Figure 7:
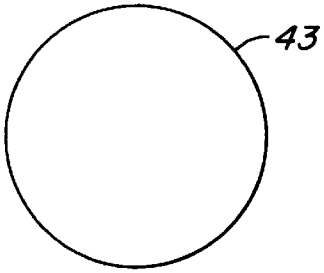
FIG. 7 is a top sectional view of the cutting element of FIG. 3 taken along the line 7—7 of FIG. 3.
Figure 3:
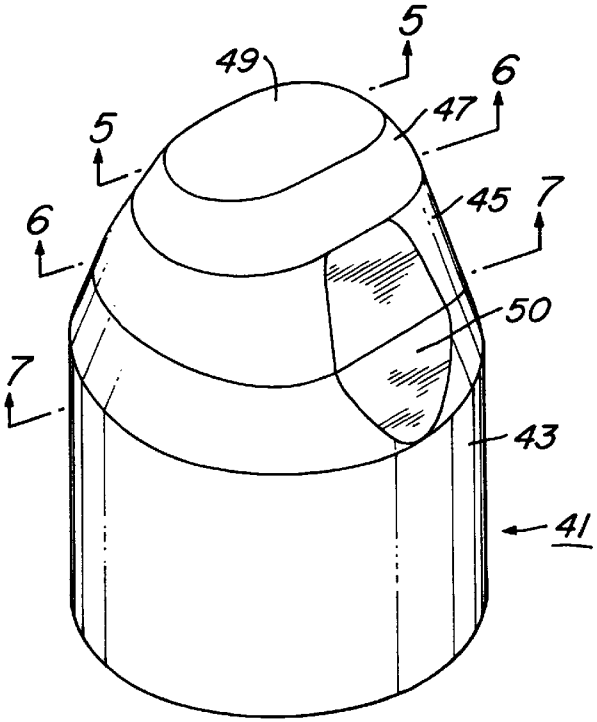
FIG. 3 is a perspective view of a cutting element constructed in accordance with the invention.

FIG. 3 is a perspective view of cutting element 41 according to the present invention. Cutting element 41 comprises a generally cylindrical base 43 (FIG. 7), which is secured by interference fit in a correspondingly dimensioned aperture in a cutter of the bit. A cutting end 45 extends from base 43 in a conventional chisel-shaped configuration. An elongate crest 49, which is formed with a circular radius 42 (FIG. 4), is located at the end or tip of cutting end 45. Radius 42 may be the same as radius 32 of FIG. 2. A conical chamfer 47 connects crest 49 and an intermediate portion 44 of cutting end 45. The junction created by chamfer 47 is non-tangential and reduces the amount of unsupported material, as shown in FIG. 4. The conical contour of chamfer 47 is defined by a straight line moving in a noncircular path (FIG. 5) about the longitudinal axis. The line, and thus chamfer 47, are at an angle 48 relative to the longitudinal axis. Angle 48 changes depending upon the point of measurement because cutting end 45 is asymmetrical, not fully symmetrical as in a conical cutting end. Angle 48 is steeper along the lateral sides of cutting element 41 than along the leading and trailing flanks or sides.

The intermediate portion 44 from cylindrical body 43 to chamfer 47 is also conical. It, too, is formed by a straight line moving in an oval path about the longitudinal axis. The straight line of intermediate portion 44 is at a lesser angle to the longitudinal axis of base 43 than the straight line of chamfer 47 at all points along the oval path. The intermediate portion 44 is at smaller angles relative to the longitudinal axis than chamfer 47. Intermediate portion 44 has a greater height than chamfer 47. Crest 49 is curved with its radius beginning at the upper edge of chamfer 47.

Figure 8:
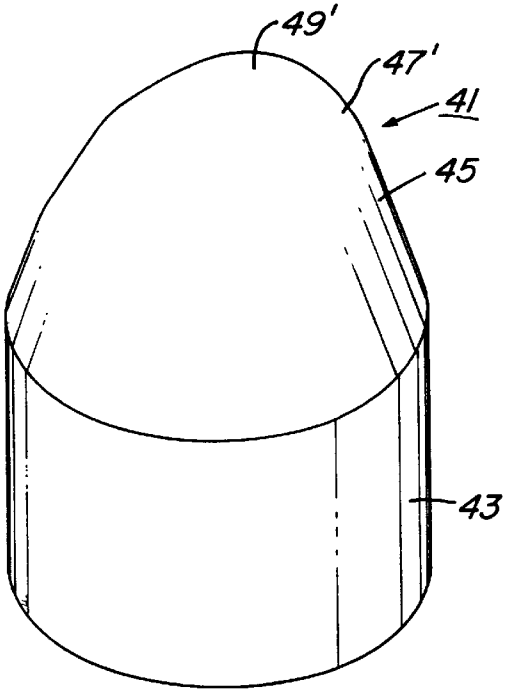
FIG. 8 is a perspective view of an alternate embodiment of the cutting element of FIG. 3.
Figure 6:
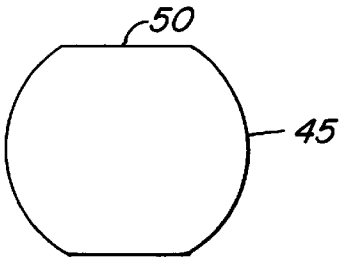
FIG. 6 is a top sectional view of the cutting element of FIG. 3 taken the line 6—6 of FIG. 3.

In the preferred embodiment of the present invention, base 43 is approximately 0.565 inch in diameter and 0.813 inch in height. Cutting end 45 is about 0.106 inch in height and its sides incline at an angle of approximately 15–30° (depending on the location about the circular perimeter of base 43) relative to the longitudinal axis. Chamfer 47 is about 0.050–0.070 inches in width and 25–45° relative to the longitudinal axis (depending on the location about body 43). Crest 49 is formed with a circular radius of about 0.178 inch. Cutting element 41 also has a flat 50 (FIGS. 3 and 6) located on opposing sides. Flat 50 is in a plane that lies at an angle relative to the longitudinal axis. As shown in FIG. 8, an identical cutting element 41' may also be constructed without flats 50. Cutting element 41' is identical to cutting element 41 except for flats 50.

According to the preferred embodiment of the present invention, the contour of cutting end 45 avoids abrupt changes and associated stress concentrations. This may be achieved by avoiding surfaces of rotation in non-axisymmetric configurations. Alternatively, the contour of cutting end of element may be conventional and include flat surfaces, surfaces of rotation, and associated fillets and radii to round or soften the contour of the intersections between such surfaces.

FIG. 4 depicts cutting element 41 in drilling operation. The provision of chamfer 47 reduces the included or sweep angle 52 of crest 49 to less than sweep angle 39 of FIG. 3. The associated amount of material of element 41 that is unsupported at relatively low to moderate depth of penetration is less than in FIG. 2. Similarly, the amount of material of element 41 that is left in a state of tensile stress and subject to chipping or spalling failure is reduced. Addition of chamfer 47 does not require modification of the radius of curvature of crest 49, but alters angle 52 included or swept by the radius of crest 49 and the amount of material left unsupported at low-to-moderate depth of cut. Thus, increased durability can be expected with little change in penetration efficiency.

The invention has advantages. The cutting element described is configured to maximize both the formation penetration efficiency and the durability of the cutting element.

While the invention has been shown or described in only some of its forms, it should be apparent to those skilled in the art that it is not so limited, but is susceptible to various changes without departing from the scope of the invention.

I claim:

1. An earth-boring bit, comprising:

a bit body;

at least one cantilevered bearing shaft depending inwardly and downwardly from the bit body;

a cutter mounted for rotation on the bearing shaft, the cutter including a plurality of cutting elements arranged in generally circumferential rows on the cutter; and at least one of the cutting elements having a cylindrical base with a longitudinal axis and secured within a hole formed in the cutter, a cutting end having an elongate crest, an intermediate portion and a chamfer located between the crest and the intermediate portion, and, in cross-section parallel to the longitudinal axis, the crest being curved, the intermediate portion being straight and inclined, and the chamfer being straight and inclined at a different angle than the intermediate portion.

2. The bit of claim 1 wherein the chamfer and the intermediate portion are defined by a straight line moving in a noncircular path about the longitudinal axis of the base.

3. The bit of claim 2 wherein the straight line of the intermediate portion is at a lesser angle relative to the longitudinal axis of the base than the straight line of the chamfer at all points along the oval path.

4. The bit of claim 2 wherein the sides of the intermediate portion are at angles of approximately 15–30 degrees relative to the longitudinal axis of the base and the sides of the chamfer are inclined at angles of 25–45 degrees relative to the longitudinal axis.

5. The bit of claim 1 wherein the cutting end has leading and trailing flanks and wherein a flat section is located on each of the flanks in the intermediate portion.

6. An earth-boring bit, comprising:

a bit body;

at least one cantilevered bearing shaft depending inwardly and downwardly from the bit body;

a cutter mounted for rotation on the bearing shaft, the cutter including a plurality of cutting elements arranged in generally circumferential rows on the cutter; and least one of the cutting elements having a cylindrical base with a longitudinal axis and secured within a hole formed in the cutter, a cutting end having a leading flank, a trailing flank and two lateral sides terminating in a rounded crest which has a longer dimension between the two lateral sides than between the two flanks, the crest having a generally noncircular perimeter, an intermediate portion extending from the base and inclining toward the crest, and a chamfer which joins the intermediate portion with the perimeter of the crest, the chamfer having a lesser height than the intermediate portion and inclining at a greater amount than the intermediate portion relative to a plane which is perpendicular to the longitudinal axis, the chamfer being defined at any point by a straight line which joins the perimeter and the intermediate portion; and wherein a straight line of the intermediate portion is at a lesser angle relative to the longitudinal axis of the base than the straight line of the chamfer at all points along the oval perimeter.

7. The bit of claim 6 wherein the sides of the intermediate portion are at angles of approximately 15–30 degrees relative to the longitudinal axis of the base and the sides of the chamfer are inclined at angles of 25–45 degrees relative to the longitudinal axis.

8. The bit of claim 6 wherein a flat section is located on each of the flanks in the intermediate portion.

9. An earth-boring bit, comprising:

a bit body;

at least one cantilevered bearing shaft depending inwardly and downwardly from the bit body;

a cutter mounted for rotation on the bearing shaft, the cutter including a plurality of cutting elements arranged in generally circumferential rows on the cutter; and at least one of the cutting elements having a cylindrical base with a longitudinal axis and secured within a hole formed in the cutter, a cutting end having a leading flank and a trailing flank each with a flat section, and two lateral sides terminating in a rounded crest which has a longer dimension between the two lateral sides than between the two flanks, the crest having a non-circular perimeter, an intermediate portion extending from the base and inclining toward the crest, and a chamfer which joins the intermediate portion with the perimeter of the crest and inclines at a greater amount than the intermediate portion relative to a plane which is perpendicular to the longitudinal axis, the chamfer being defined at any point by a straight line which joins the perimeter and the intermediate portion; and wherein a straight line of the intermediate portion is at a lesser angle relative to the longitudinal axis of the base than the straight line of the chamfer at all points along the oval perimeter; and wherein the sides of the intermediate portion are at angles of approximately 15–30 degrees relative to the longitudinal axis of the base and the sides of the chamfer are inclined at angles of 25–45 degrees relative to the longitudinal axis.

* * * * *